US009764922B2

(12) United States Patent
Sharp et al.

(10) Patent No.: US 9,764,922 B2
(45) Date of Patent: Sep. 19, 2017

(54) ANTI MISUSE SYSTEM

(75) Inventors: Graham Sharp, Renfrew (GB); Cheryl Campbell, Telford (GB)

(73) Assignee: WRAP FILM SYSTEMS LIMITED, Shropshire (GB)

( * ) Notice: Subject to any disclaimer, the term of this patent is extended or adjusted under 35 U.S.C. 154(b) by 465 days.

(21) Appl. No.: 13/884,853

(22) PCT Filed: May 27, 2011

(86) PCT No.: PCT/GB2011/051011

§ 371 (c)(1),
(2), (4) Date: Sep. 27, 2013

(87) PCT Pub. No.: WO2012/123692

PCT Pub. Date: Sep. 20, 2012

(65) Prior Publication Data

US 2014/0008477 A1 Jan. 9, 2014

(30) Foreign Application Priority Data

Mar. 14, 2011 (GB) ..... 1104262.9

(51) Int. Cl.
*B65H 75/18* (2006.01)
*B65H 35/00* (2006.01)
*B65H 16/00* (2006.01)

(52) U.S. Cl.
CPC ..... *B65H 75/18* (2013.01); *B65H 16/005* (2013.01); *B65H 35/002* (2013.01); (Continued)

(58) Field of Classification Search
CPC .... B65H 75/18; B65H 75/185; B65H 16/005; B65H 2301/41369; B65H 2701/1842; B65H 2402/61; B65H 2402/64
See application file for complete search history.

(56) References Cited

U.S. PATENT DOCUMENTS 3,679,110 A * 7/1972 Stine ..... B65D 85/672 225/47
4,129,266 A * 12/1978 Masiello ..... B65H 16/06 242/578.2

(Continued)

FOREIGN PATENT DOCUMENTS

GB 2471685 A 1/2011

OTHER PUBLICATIONS

EP Search Report reported Jul. 8, 2011 for corresponding EP application GB1104262.9, and references cited therein.

*Primary Examiner* — William A Rivera
(74) *Attorney, Agent, or Firm* — Olive Law Group, PLLC

(57) ABSTRACT

An anti-misuse system for a sheet dispenser having a roll of sheet material and a housing to receive the roll. The anti-misuse system includes an end portion of a roll incorporating a first projection and a corresponding end wall portion of the housing comprising a retracting portion incorporating an interacting mechanism. The retracting portion is movable between a deployed position in which the interacting mechanism affects the functionality of the sheet dispenser and a retracted position in which the interacting mechanism enables the sheet dispenser to be functional. The retracting portion further incorporates an abutment drivable by the projection upon insertion of the roll into the housing to move the retracting portion into the retracted position.

19 Claims, 15 Drawing Sheets

(52) U.S. Cl.
CPC . *B65H 75/185* (2013.01); *B65H 2301/41369* (2013.01); *B65H 2402/61* (2013.01); *B65H 2402/64* (2013.01); *B65H 2701/1752* (2013.01); *B65H 2701/1842* (2013.01)

(56) References Cited

U.S. PATENT DOCUMENTS

| | | | | | |
|---|---|---|---|---|---|
| 5,156,354 | A * | 10/1992 | Robertson | B65H 16/00 | 242/410 |
| 5,314,134 | A * | 5/1994 | Harris | B65H 16/00 | 242/348 |
| 5,335,873 | A * | 8/1994 | Harris | B65H 16/00 | 242/348 |
| 5,597,135 | A * | 1/1997 | Vandersteene | B65H 16/005 | 242/599.3 |
| 6,412,725 | B2 * | 7/2002 | Inana | G03B 23/02 | 242/348 |
| 6,824,091 | B2 * | 11/2004 | Inana | B65H 16/06 | 242/578 |
| 6,948,673 | B1 | 9/2005 | Sato | | |
| 7,000,520 | B2 * | 2/2006 | Nichols | B26D 1/045 | 225/47 |
| 7,278,544 | B2 * | 10/2007 | Blateri | B65H 16/005 | 211/12 |
| 7,284,725 | B2 * | 10/2007 | Inana | B41J 15/042 | 242/578 |
| 7,780,112 | B2 * | 8/2010 | Granger | A47K 10/38 | 242/596.7 |
| 8,006,929 | B2 * | 8/2011 | Lind | A47K 10/36 | 242/129.51 |
| D666,442 | S * | 9/2012 | Sharp | D6/518 | |
| 8,366,036 | B2 * | 2/2013 | Ozaki | B65H 16/06 | 242/596.1 |
| 2007/0018023 | A1 * | 1/2007 | Ness | B65D 85/671 | 242/160.1 |
| 2007/0137454 | A1 * | 6/2007 | DesRosiers | B26D 1/045 | 83/614 |
| 2009/0212152 | A1 * | 8/2009 | Ozaki | B65H 16/06 | 242/596.4 |
| 2010/0314486 | A1 * | 12/2010 | Wightman | B65H 35/002 | 242/598.6 |
| 2012/0111988 | A1 * | 5/2012 | Dean | B65H 16/005 | 242/597.6 |
| 2013/0075511 | A1 * | 3/2013 | de Jong | B65H 16/005 | 242/171 |
| 2014/0027553 | A1 * | 1/2014 | Page | B65H 16/005 | 242/159 |

* cited by examiner

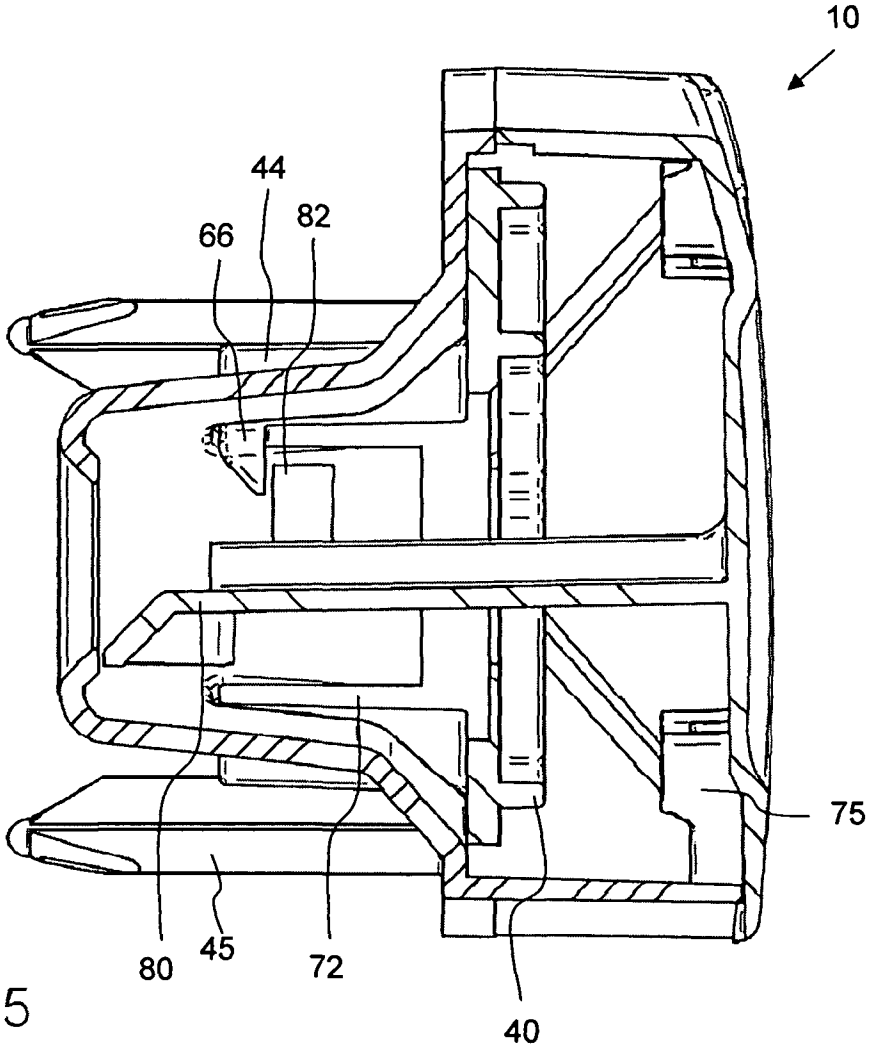
FIG. 5
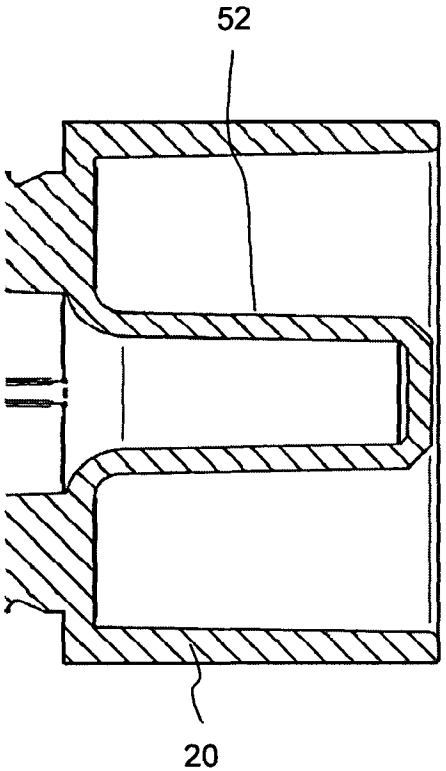

ANTI MISUSE SYSTEM

CROSS REFERENCE TO RELATED APPLICATION

This application is a 35 USC 371 application of International PCT Patent Application No. PCT/GB2011/051011 filed on May 27, 2011, and further claims priority to GB1104262.9 filed Mar. 14, 2011, the entire contents of both are hereby incorporated by reference herein.

The present invention relates to an anti misuse system. More specifically, but not exclusively, the present invention relates to an anti misuse system for dispensers of sheet material.

The present applicant is the manufacturer of a successful dispensing system for dispensing sheet material, such as cling film, foil and greaseproof paper, from a roll contained within a housing that is configured to receive the roll. The housing is provided with a lid having a cutting blade to efficiently sever sheet material at a desired length when the lid is closed against a cutting channel across which the film is tensioned. The basic functionality of this dispenser is shown in WO03099693 (Benedetti International plc). However, it is possible with the basic dispenser of this type for rolls containing the wrong material, or material of an incorrect grade or dimensions, to be loaded into the dispenser and usability of the dispenser to be impaired.

The present invention seeks to overcome or at least mitigate the problems of the prior art.

According to the present invention there is provided an anti-misuse system for a sheet dispenser having a roll of sheet material and a housing to receive the roll, the anti-misuse system comprising:

an end portion of a roll incorporating a first projection;

a corresponding end wall portion of the housing comprising a retracting portion incorporating an interacting mechanism, the retracting portion being movable between a deployed position in which the interacting mechanism affects the functionality of the sheet dispenser and a retracted position in which the interacting mechanism enables the sheet dispenser to be functional, wherein the retracting portion further incorporates an abutment drivable by the projection upon insertion of the roll into the housing to move the retracting portion into the retracted position.

The housing may further comprise a lid and the interacting mechanism may block closure of the lid. The lid may incorporate a portion of a severing mechanism for severing the sheet material. The interacting mechanism may comprise a lug arranged to extend inwardly from the end wall portion when in the deployed position. The housing advantageously incorporates an axle arranged to support rotation of the end portion thereon.

The end portion may further comprise a second projection radially separated from the first projection, and the end wall portion may comprise a latch mechanism arranged to restrain the retracting portion from retracting, the second projecting portion being arranged to release the latch mechanism upon insertion of the roll prior to the abutment being driven. The latch mechanism comprises a ramp surface arranged such that insertion of the second projection causes a portion of the latch mechanism to pivot to release. A first portion of the latch mechanism is preferably associated with the retracting portion and even more preferably integral therewith, e.g. by being formed as a single moulded part. A second portion of the latch may be associated with the housing, preferably an axle of the housing, preferably within an aperture of the axle. Alternatively the second portion may be located on an end wall of the housing.

The anti-misuse system may further comprise a shroud configured to restrict access to the drivable abutment. The lug may be positioned in a generally inaccessible location, preferably adjacent tensioning surfaces for the sheet material. The retracting portion may comprise a single component, may be resiliently biased into the deployed position, and may comprise resilient legs.

The end portion of the roll may be a bung. The roll sheet material may extend over the bung. The second projection may be arranged concentrically within the first projection. The end wall portion may be removable and may allow the insertion of the roll into the housing when removed.

According to a second aspect of the present invention, there is further provided a roll of sheet material for a sheet dispenser incorporating at an end a bung shaped for the operation of a retracting portion incorporating an interacting mechanism, the retracting portion being movable between a deployed position in which the interacting mechanism affects the functionality of the sheet dispenser and a retracted position in which the interacting mechanism enables the sheet dispenser to be functional. Preferably, the end portion comprises a first projection and a second projection radially separated from the first projection, the first projection being dimensioned so as to release the interacting portion upon insertion, and the second projection being arranged to retract the retracting portion upon insertion. Even more preferably the first portion and the second portion are concentrically arranged A third aspect of the present invention provides a housing to receive the roll of sheet material for dispensing, the housing comprising:

an end wall portion, the end wall portion including a retracting portion incorporating an interacting mechanism, the retracting portion being movable between a deployed position in which the interacting mechanism affects the functionality of the sheet dispenser and a retracted position in which the interacting mechanism enables the sheet dispenser to be functional, wherein the retracting portion further incorporates an abutment drivable by the projection upon insertion of a roll of sheet material into the housing to move the retracting portion into the retracted position.

According to a fourth aspect of the present invention, there is further provided a sheet dispenser having a roll of sheet material and a housing to receive the roll and comprising an anti-misuse system, the anti-misuse system comprising:

an end portion of a roll incorporating a first circular projection;

a corresponding end wall portion of the housing comprising a retracting portion incorporating an interacting mechanism, the retracting portion being movable between a deployed position in which the interacting mechanism affects the functionality of the sheet dispenser and a retracted position in which the interacting mechanism enables the sheet dispenser to be functional, wherein the retracting portion further incorporates an abutment drivable by the projection upon insertion of the roll into the housing to move the retracting portion into the retracted position.

Embodiments of the present invention will now be described in detail with reference to the accompanying figures in which:

FIG. 5 is a vertical cross-sectional view of the system of the first embodiment;

Figure 1:
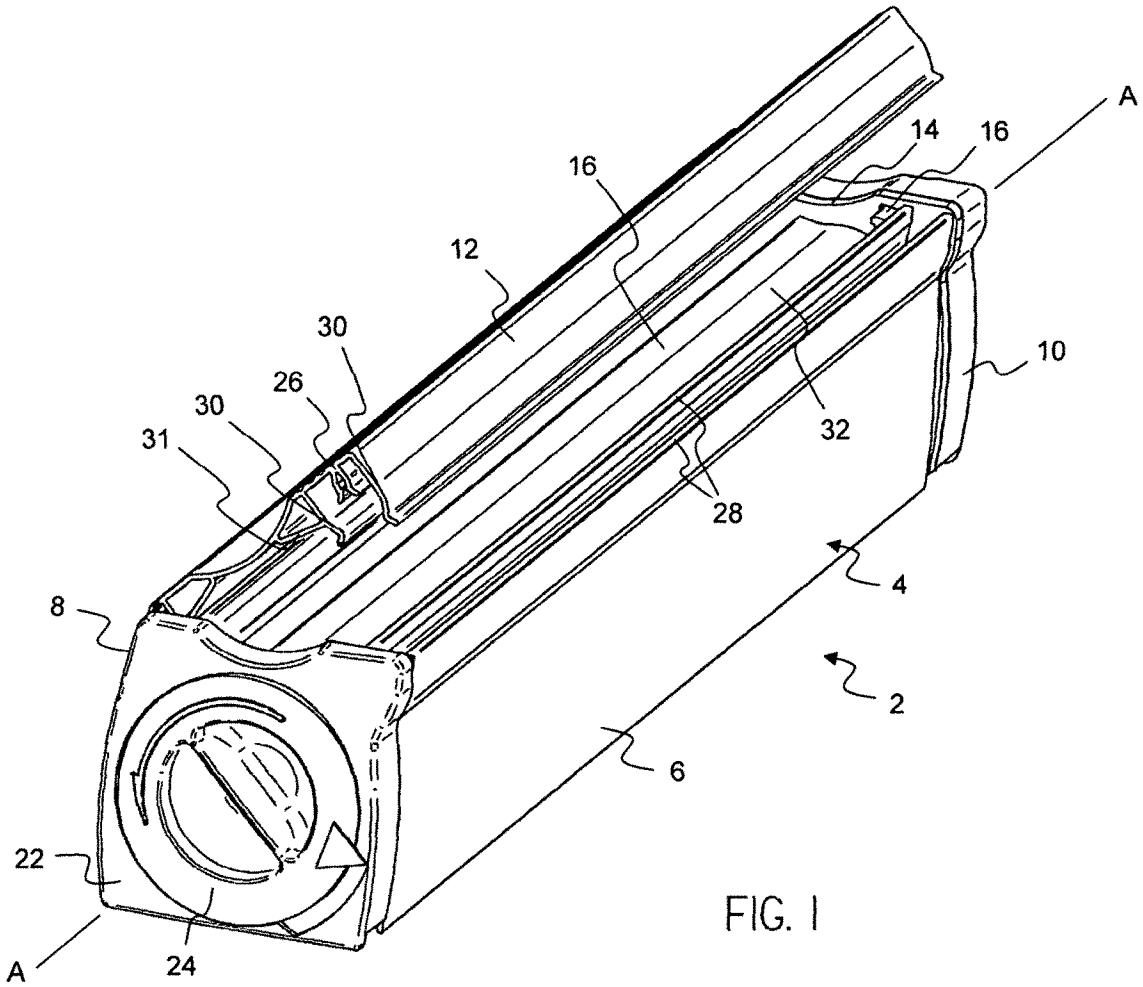
FIG. 1 is an isometric view of a sheet dispenser incorporating an anti-misuse system according to a first embodiment of the present invention.
Figure 14:
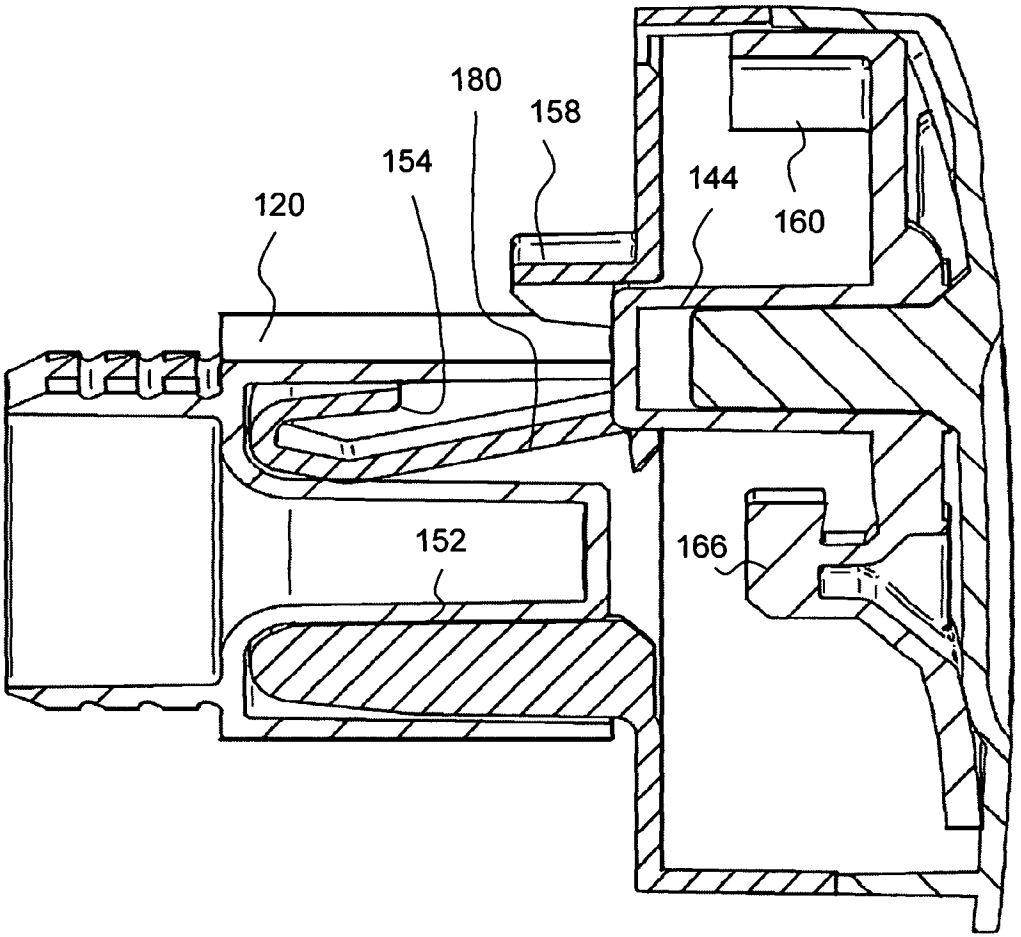
Figure 15:
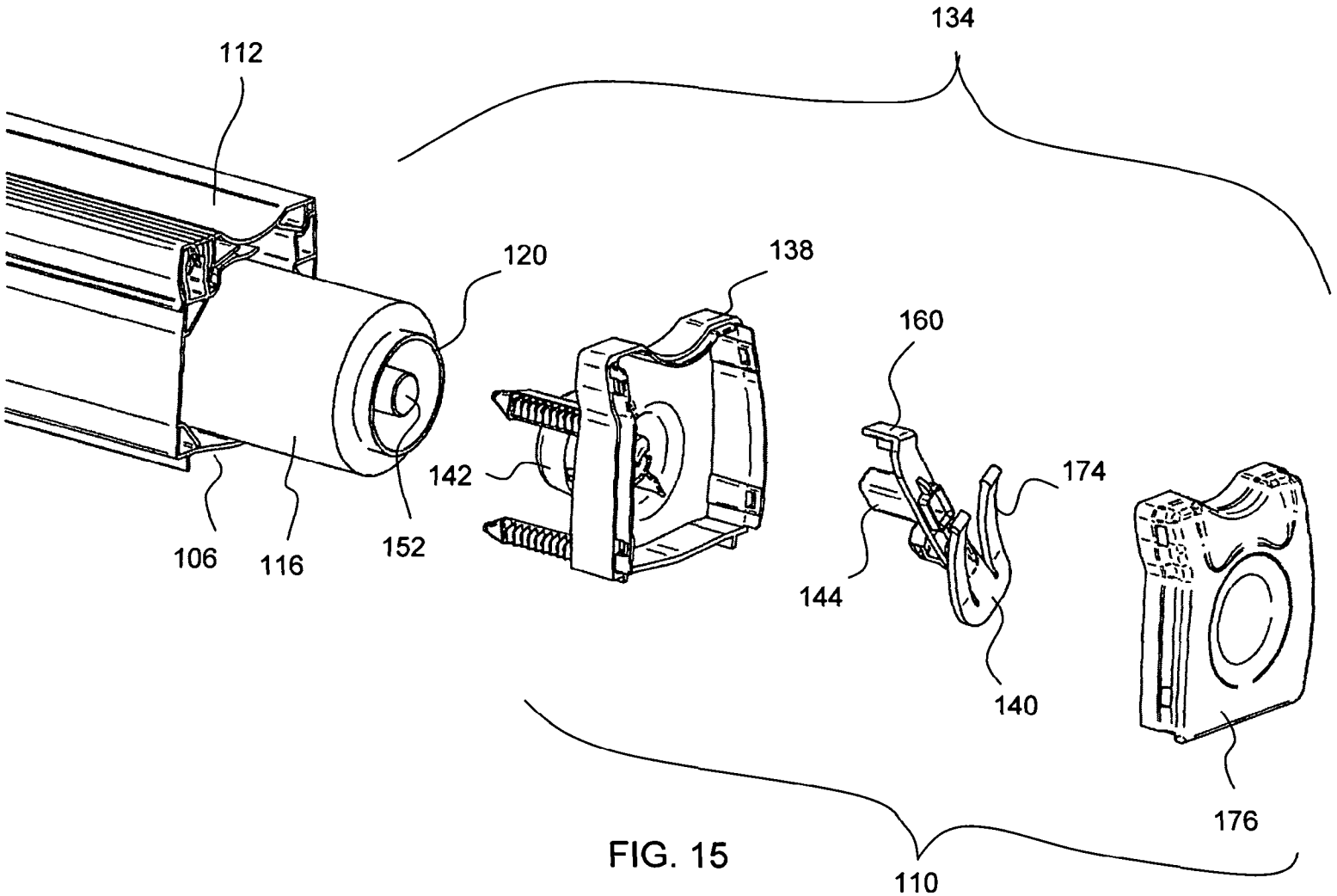

FIG. 14 is a is a vertical cross-sectional view of the system in a second stage of installation; and FIG. 15 is an exploded view of the system of the second embodiment of the present invention With reference to FIG. 1, a sheet dispenser indicated generally at 2 is illustrated, which comprises a housing 4 formed from a body portion 6, a first end cap assembly 8, a second end cap assembly 10 and a lid 12 formed integrally with the body 6 and having a live hinge connection thereto. Loaded within the housing 4 is a roll 14 of thin and flexible sheet material 16, such as cling film, foil, greaseproof paper, or wrapping paper defining an axis A-A. The sheet material 16 is supported along a major portion of its length by a cardboard supporting tube or core 18 (see FIG. 3) but at its end has a support in the form of a bung 20 of a particular shape that forms one part of the system of the present invention. The first end cap assembly 8 comprises an end wall 22 in which a removable end cap 24 is mounted using a bayonet style fitting. Anti-clockwise rotation of the end cap 24 enables this to be removed and the roll 14 to be replaced by its removal through the hole that is then created in the end wall 22 along the axis A-A. A replacement roll may then be inserted in a reverse of the process. The end cap 24 incorporates a stub axle (not shown) that fits within the end of the supporting tube 18 and supports it as it rotates during dispensing.

A length of the sheet material 16 is dispensed by a user grasping the free end thereof, pulling it outwardly to a desired length and snapping the lid 12 closed. The lid 12 includes a serrated cutting blade (not shown) mounted between a pair of jaws 26 running parallel to axis A-A and facing downwardly towards a pair of spaced parallel tensioning surfaces 28. The surfaces 28 co-operate with corresponding surfaces 30 mounted on the lid 12 either side of the blade so that when the lid 12 is closed the sheet material is tensioned between the surfaces 28 and the blade is able to effectively cut the sheet material. The severed length of material can then be used as desired. A platen 32 is provided over part of the opening in the top of the housing 4 such that the end of the film material overlies the platen 32, is retained thereon to resist it rolling back onto the core, and is therefore easy to grasp for subsequent dispensing steps.

Different sheet materials have different requirements in terms of severing blade design and/or tensioning surfaces because of their material properties. In addition, differing dispensers may be designed for use with different core and roll inner and outer diameters. It is desirable for the correct replacement roll only to fit in the appropriate housing.

To this end, an anti misuse system according to the present invention is provided on the sheet dispenser 2.

Figure 10:
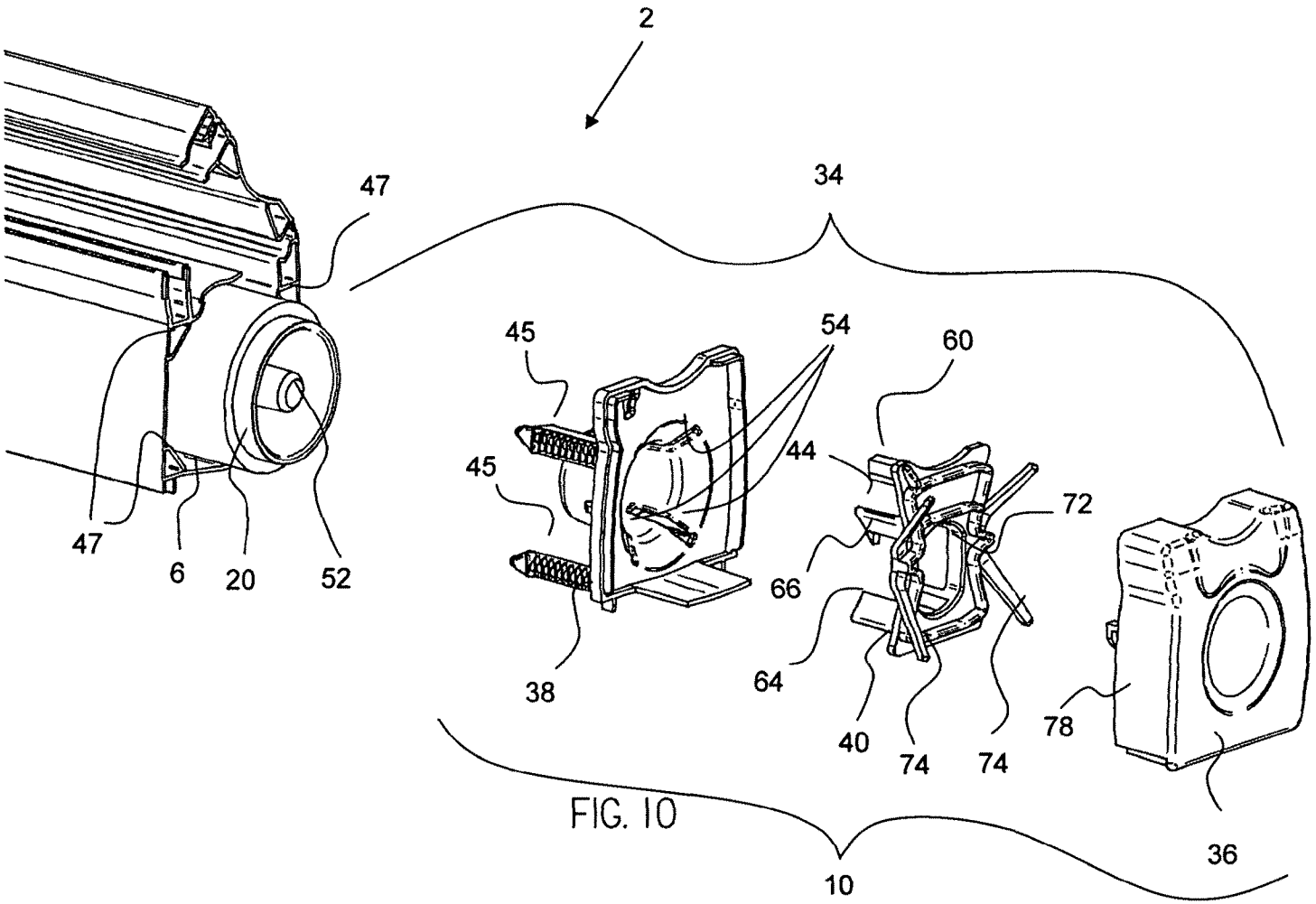
FIG. 10 is an exploded view of the system of the first embodiment of the present invention.

With reference to FIG. 10 the components of the anti misuse system are designated generally by the reference number 34 and comprise a second end wall assembly 10 and bung 20 that are adapted from the known end wall and bung of this dispenser as will be described in more detail below.

Figure 4:
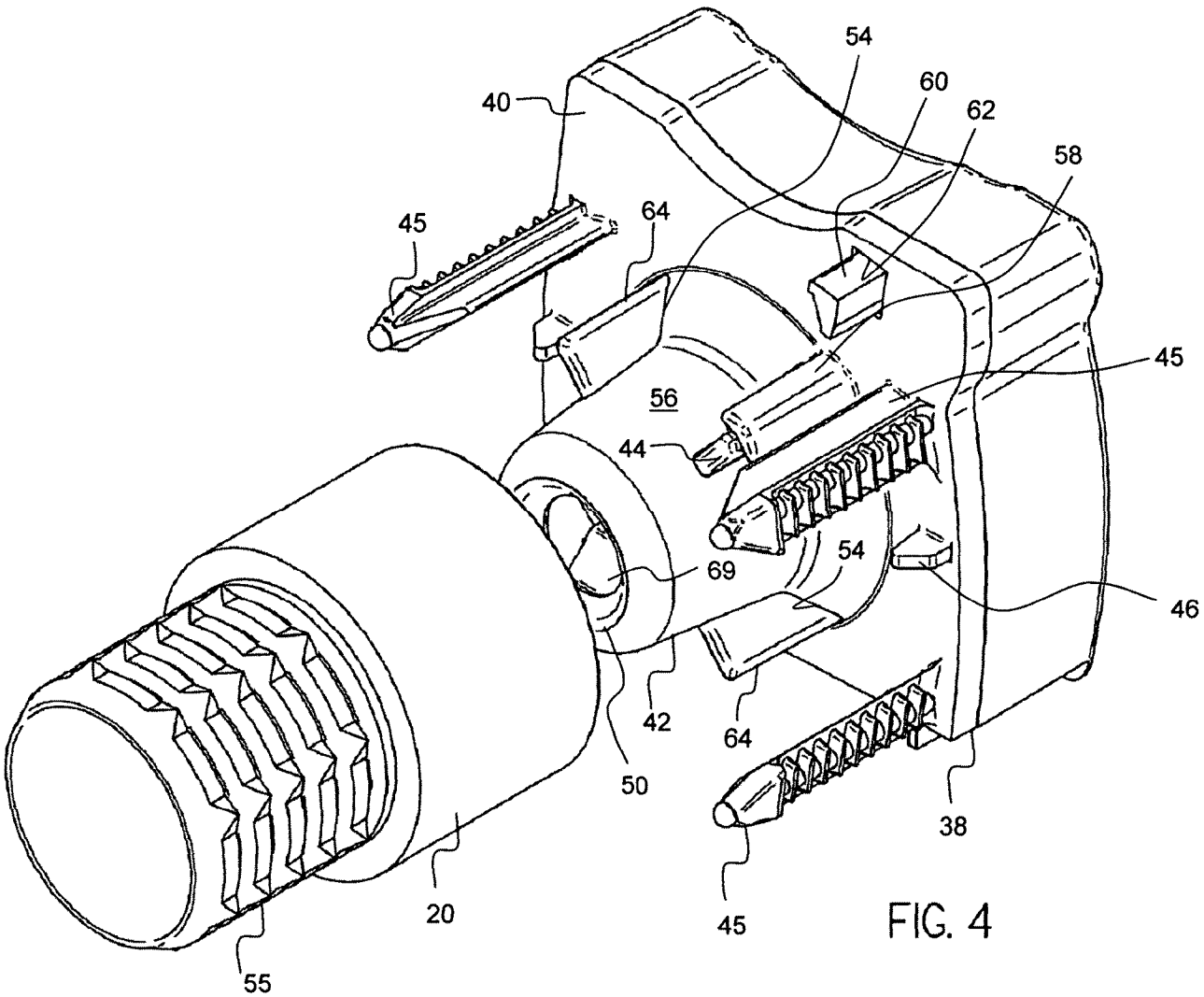
FIG. 4 is an exploded view of the system of the present invention.

It can be seen that the end wall assembly 10 comprises further components as compared to the known end wall. Specifically, the components include an end wall outer 36, an end wall inner 38 and an interacting mechanism in the form of a plate 40 that is located between the inner 38 and outer 36. Referring now in particular to FIG. 4 it can be seen that the end wall inner 38 comprises a substantially planar wall 41 from which a frustro-conical stub axle 42 and four push fit frictionally engaging fingers 45 extend. Additionally, two guide lugs 46 are preferably provided to project from the wall.

The stub axle 42 comprises an aperture 48 in an inner wall 50 thereof that is shaped to guide a corresponding inner projection 52 of the bung 20. Four further slot-shaped apertures 54 are provided in the axle 42 in the conical surface 56 thereof.

In addition, a shroud finger 58 projects from the planar wall 41 in a position that is radially outward of at least one of the slotted apertures 54. The shroud finger 58 is configured to restrict access to a drive block 44 of the interacting mechanism (see below). Finally, the end cap inner 38 includes a further aperture 62 that is positioned radially outward of the shroud finger 58 and is configured to receive a lug 60 (see below).

Figure 3:
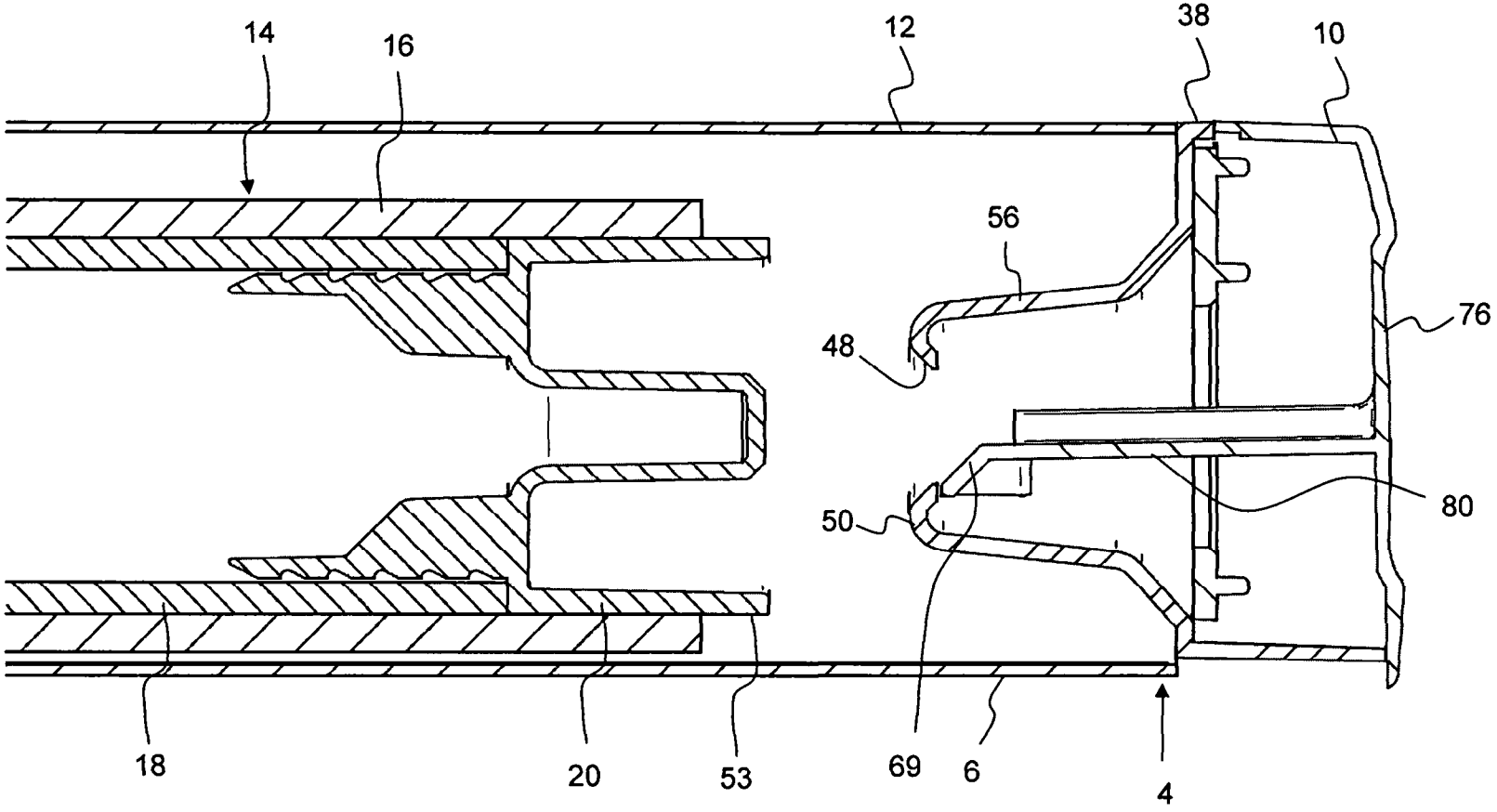
FIG. 3 is a vertical cross-sectioned view of one end of the dispenser incorporating the anti-misuse system with certain components omitted for clarity.

With continued reference to FIGS. 3 and 10, the interacting mechanism plate 40 comprises four elongate drivable abutment members 64 configured to extend through the slotted apertures 54 in the end wall inner 38. The abutment member 64 that extends through the slotted aperture 54 radially inward the shroud finger 58 is the drive block 44, and has a hook 66 of a latch mechanism for interaction with a ledge 68 of the end wall outer 36 (see below). The members 64 are arranged radially about an oval plate aperture 70 having a wall 72 that extends up the insides of the abutment members 64, providing support thereto.

On the side of the plate 40 proximal the end wall outer 36, the plate 40 comprises two sets of resilient legs 74 extending at an angle towards the end wall outer 36. When assembled, the legs 74 bias the plate 40 away from the end wall outer 36 and towards the end wall inner 38. On the side of the plate 40 proximal the end wall inner 38, the plate 40 comprises a lug 60, positioned at a corner corresponding to the aperture 62 in the end wall inner 38.

The end wall outer 36 comprises a substantially planar end wall 76 with side walls 78 extending towards the end wall inner 38 and are secured thereto in a tamper resistant way (e.g. by resilient clips, adhesive and/or heat bonded). The end wall outer 36 includes a further portion of the latch mechanism in the form of a lever arm 80 positioned towards the centre of the end wall 76 and extending towards the end wall inner 38. When the second end cap assembly 10 is assembled, the lever arm 80 extends through the aperture 70 of the plate 40. The lever arm has a ledge 82 towards its end away from the end wall 76, which interacts with the hook 66 such that the plate 40 is prevented from moving towards the end wall 76 of the end wall outer 36 unless the lever arm 80 is deflected so that the ledge 82 is disengaged from the hook 66. The end of the lever arm 80 away from the end wall 76 is chamfered to form a ramp surface 69 configured to ease deflection of the lever arm 80 away from the hook 66.

When assembled, the side walls 78 of the end wall outer 36 meet the end wall inner 38, thus enclosing the interacting mechanism plate 40. The fingers 45 frictionally engage in complementary channels 47 (see FIG. 10) in the body portion 6.

FIG. 3 also shows the bung 20. The bung 20 comprises an annular outer projection 53 extending concentrically around and in the same direction as the cylindrical projection 52. The outer surface of the outer projection 53 is of the same diameter as the supporting tube 18. The bung 20 further comprises a ridged projection 55 that is fitted inside the supporting tube 18 so that the outer projection 53 is adjacent the end of the tube 18. The sheet material 16 extends over the outer projection 53, making removal of the bung 20 difficult before the material 16 is finished.

Figure 2:
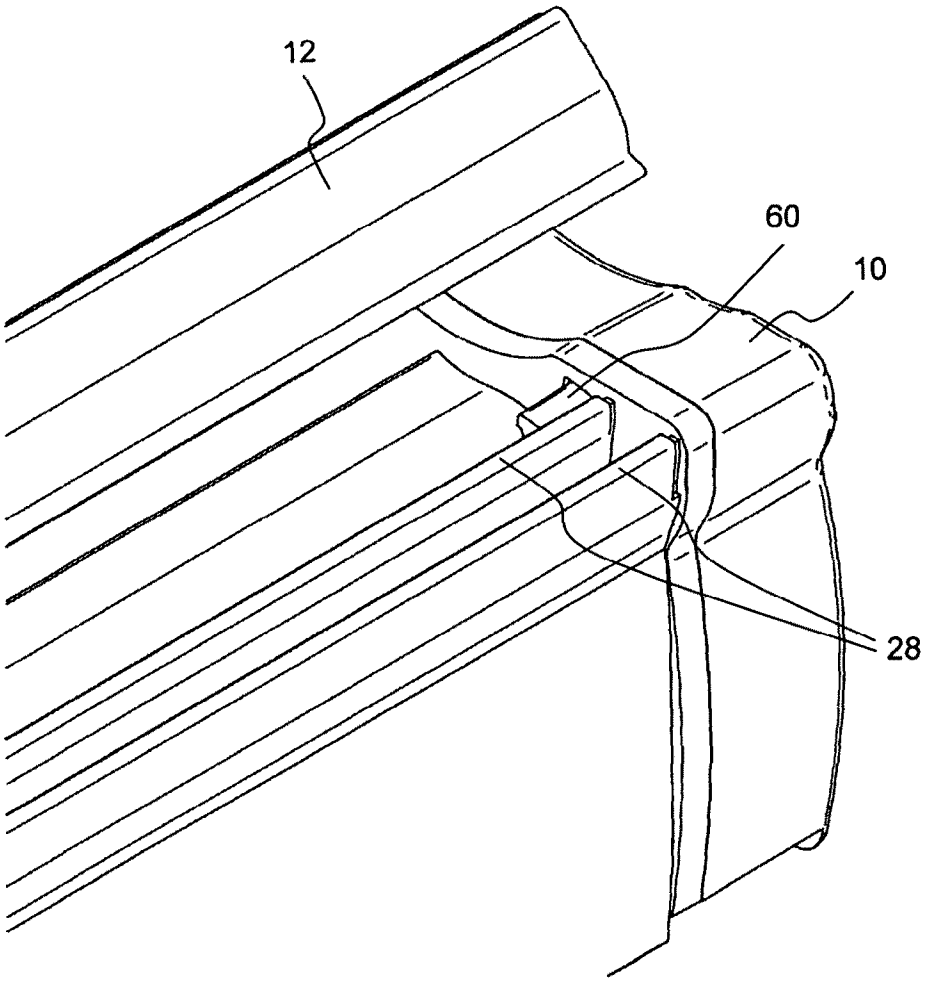
FIG. 2 is an enlarged isometric view of one end of the dispenser of FIG. 1.

When assembled with the remainder of the housing 4, the anti-misuse system prevents closure of the lid 12, and so prevents or substantially inhibits cutting of the sheet material. Prevention of lid closure is achieved by the lug 60. FIG. 2 shows the lug 60 extending in such a position as to interfere with an inner surface 31 upon attempted lid closure. In order for the lid 12 to be closed and cutting of the sheet material to be carried out, the lug 60 must be retracted. This is achieved as follows:

Upon insertion of a replacement roll of material, the bung 20 engages with the end cap assembly 10. The projection 52 of the bung 20 extends into the aperture 48 of the end wall inner 38 and deflects the lever arm 20 as it rides up the ramp surface 69. The ledge 82 is thus disengaged from the hook 66, allowing the plate 40 to be moved towards the end wall 76.

Figure 6:
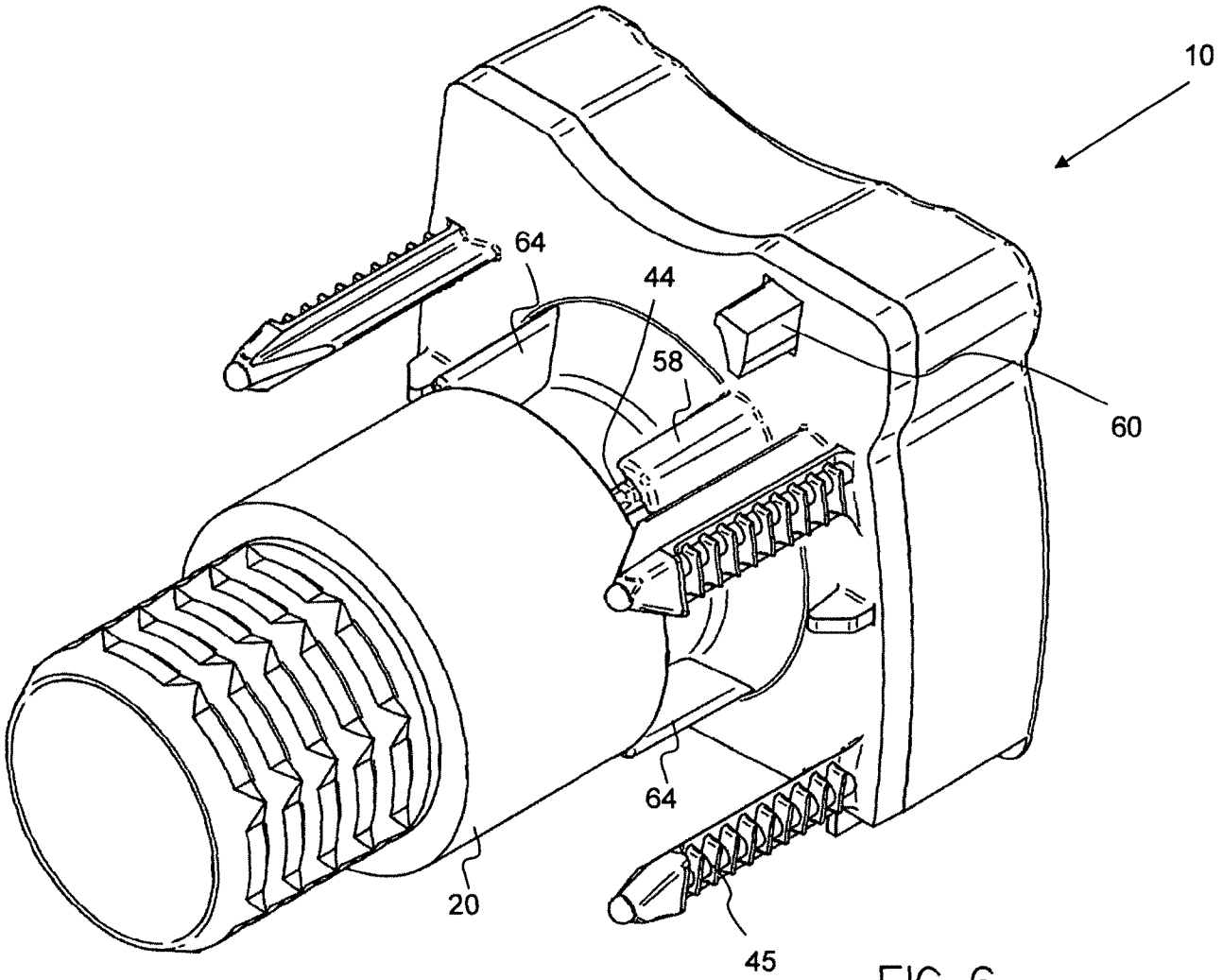
FIG. 6 is an isometric view of the system at a first stage of installation.
Figure 7:
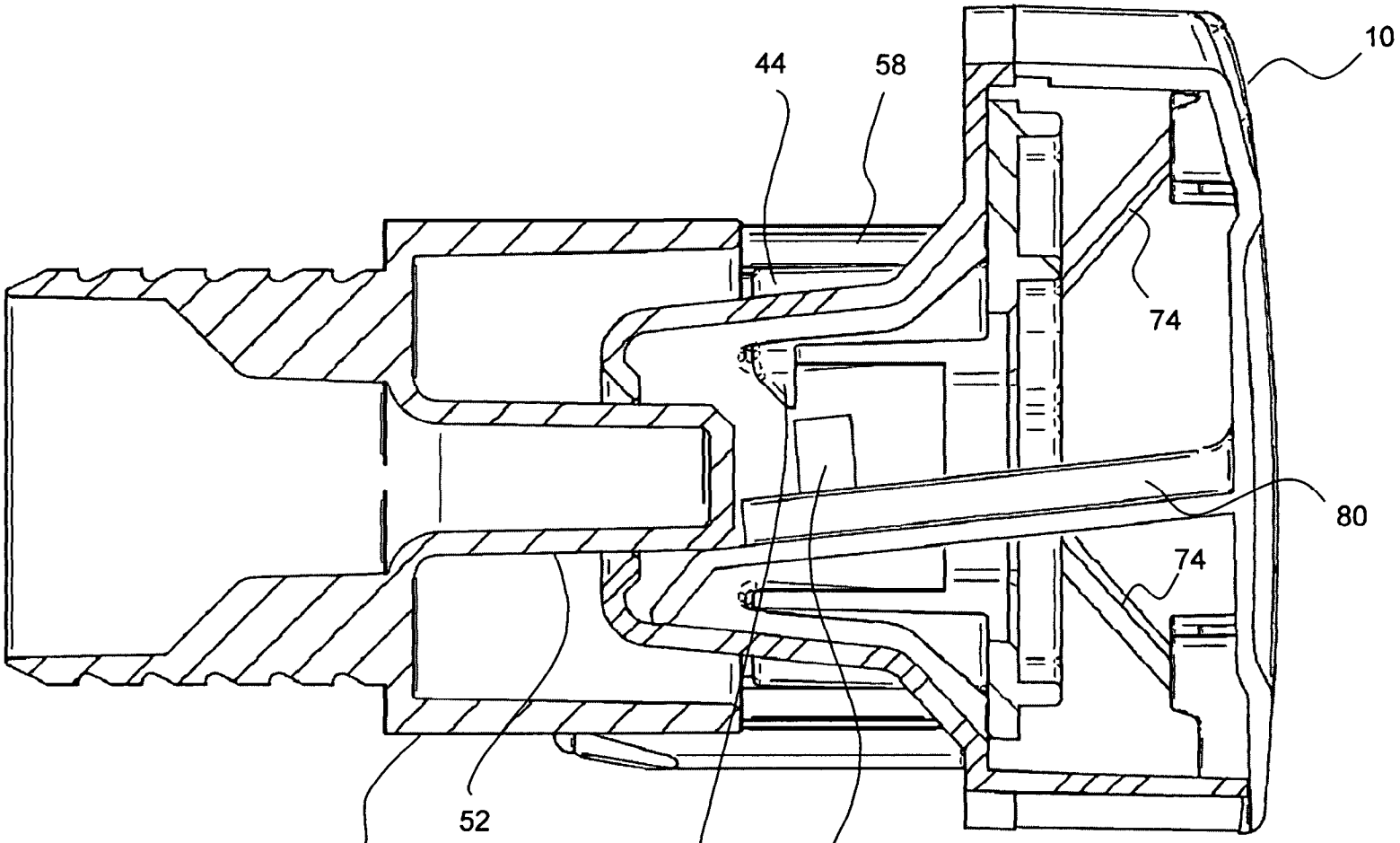
FIG. 7 is a vertical cross-sectional view of the system in the first stage shown in FIG. 6.

FIGS. 6 and 7 show the anti-misuse system at a first stage of installation of a replacement roll. The bung projection 52 has deflected the lever arm 80, but the plate 40 has not yet been retracted and is held in position by the resilient legs 74, so the lug 60 remains in its extended position.

Figure 8:
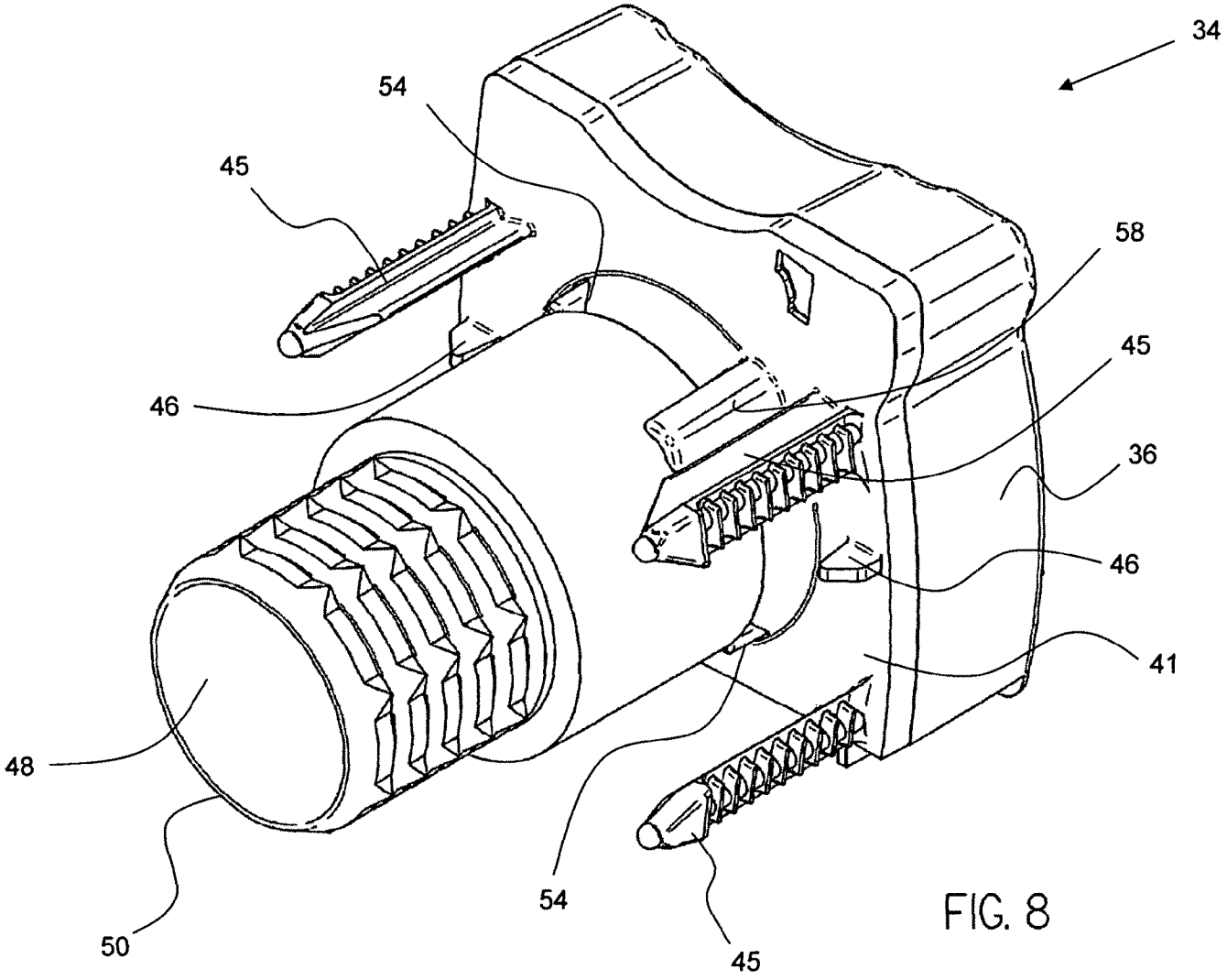
FIG. 8 is an isometric view similar to FIG. 6 but at a second stage of installation.
Figure 9:
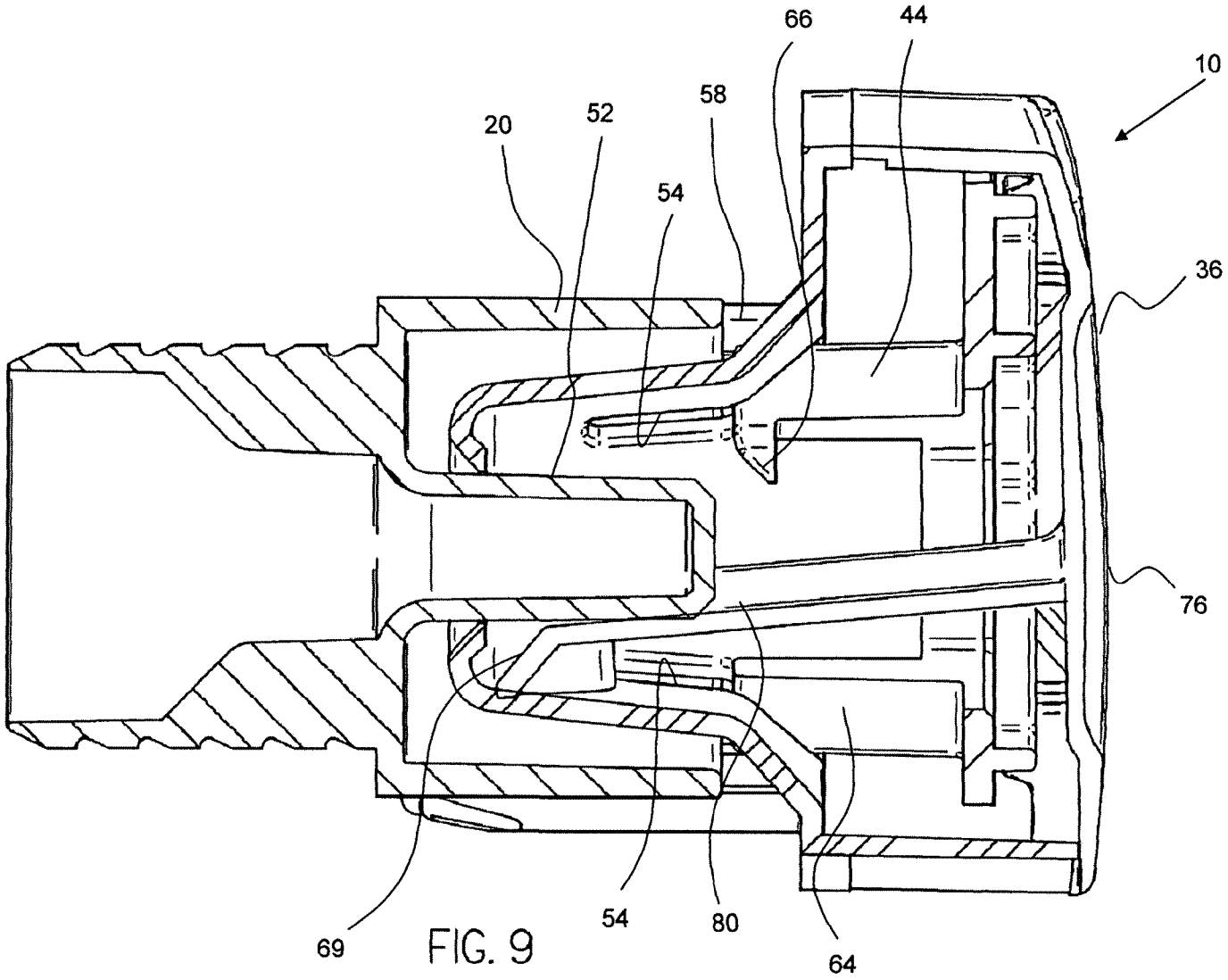
FIG. 9 is a vertical cross-sectional view of the system in the second stage of installation shown in FIG. 8.

FIGS. 8 and 9 show the anti-misuse system once the replacement roll has been fully inserted. The outer projection 53 of the bung 20 has come into contact with the abutment members 64 and moved them, and the remainder of the plate 40, towards the end wall 76. The pressure applied by the user on the insertion of the replacement roll overcomes the bias in the opposite direction provided by the resilient legs 74. The lug 60 is retracted with the rest of the plate 40 and once the end cap 10 is secured, is held in this position. Once the plate 40 is fully retracted, the lug 60 no longer interferes with lid closure, allowing the lid 12 to be used to cut the sheet material.

It is apparent from the system as described above that a replacement roll of sheet material not having a bung 20 with the correct inner and outer projections 52, 53 would not cause the plate 40 to retract on insertion into the housing 4. The lug 60 would therefore remain in place, preventing closure of the lid 12 and accompanying cutting of the sheet material. In this way, it is possible to allow only rolls of the correct material grade and dimension to be used in the dispenser, and thus to avoid impairment of the dispenser due to the wrong type of material or roll being used.

FIGS. 11 to 15 illustrate a second embodiment of the present invention in which like components are denoted by like numerals, but with the addition of the prefix "1". Only those components that differ from the first embodiment are discussed in detail below.

Figure 11:
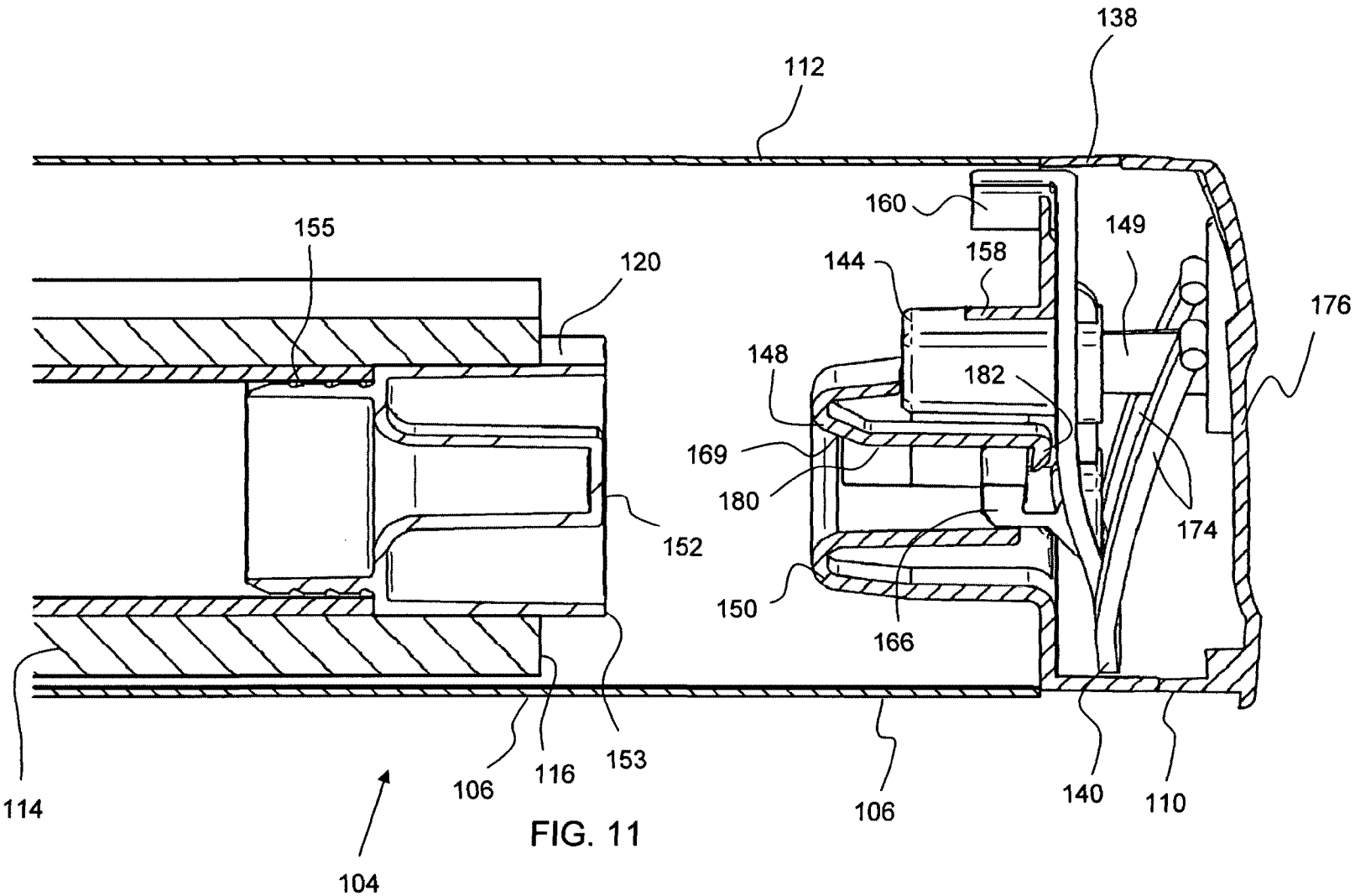
FIG. 11 is a vertical cross-sectioned view of one end of a dispenser incorporating an anti-misuse system according to a second embodiment of the present invention.
Figure 12:
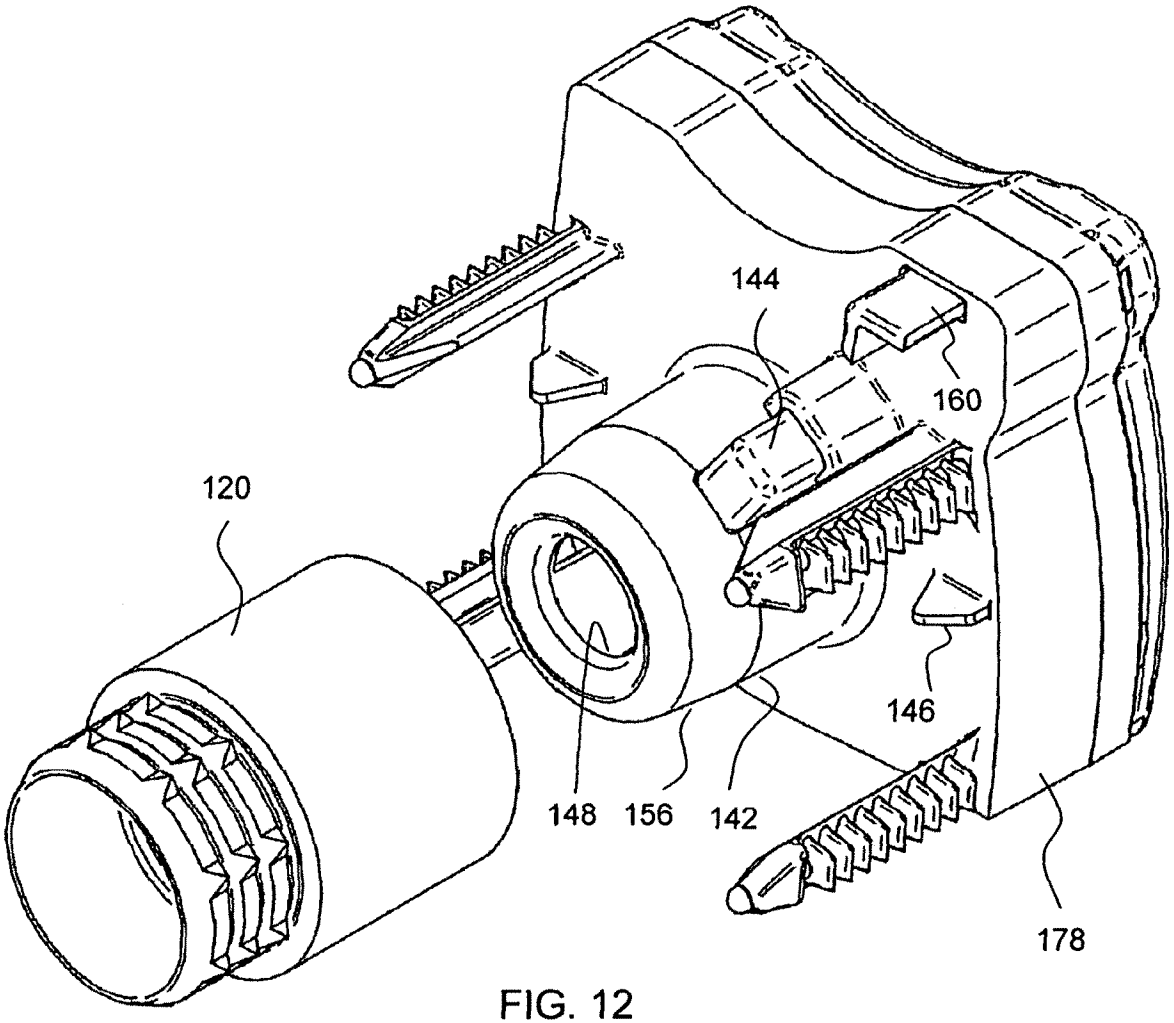
FIG. 12 is an exploded view of the system of FIG. 11.

In this embodiment, the fundamental operation of the anti-misuse system 134 is the similar to the first embodiment. However, a number of components have been changed as follows:

With reference to FIGS. 11 and 15, the lever arm 180 is now formed from an inner face of the aperture 148 configured such that the aperture is narrower than the diameter of the inner projection 152, but the arm is deformable radially outwardly to accommodate the inner projection upon insertion thereof. A ramp surface 169 aids insertion. A ledge 182 is provided at the outer end of the lever arm. This ledge retains a hook 166 when in the extended position shown in FIG. 11.

In a further variation only a single drive block 144 is provided, and to assist the smooth retraction thereof, the block is hollow and receives a guide finger 149 that projects inwardly from the end wall 176.

Finally, the biasing of the interacting mechanism plate 140 is achieved in this embodiment by a pair of resilient legs 174 in a spaced substantially parallel arrangement in which they extend either side of the guide finger 149 and are slideable on an inner surface of the end wall.

Figure 13:
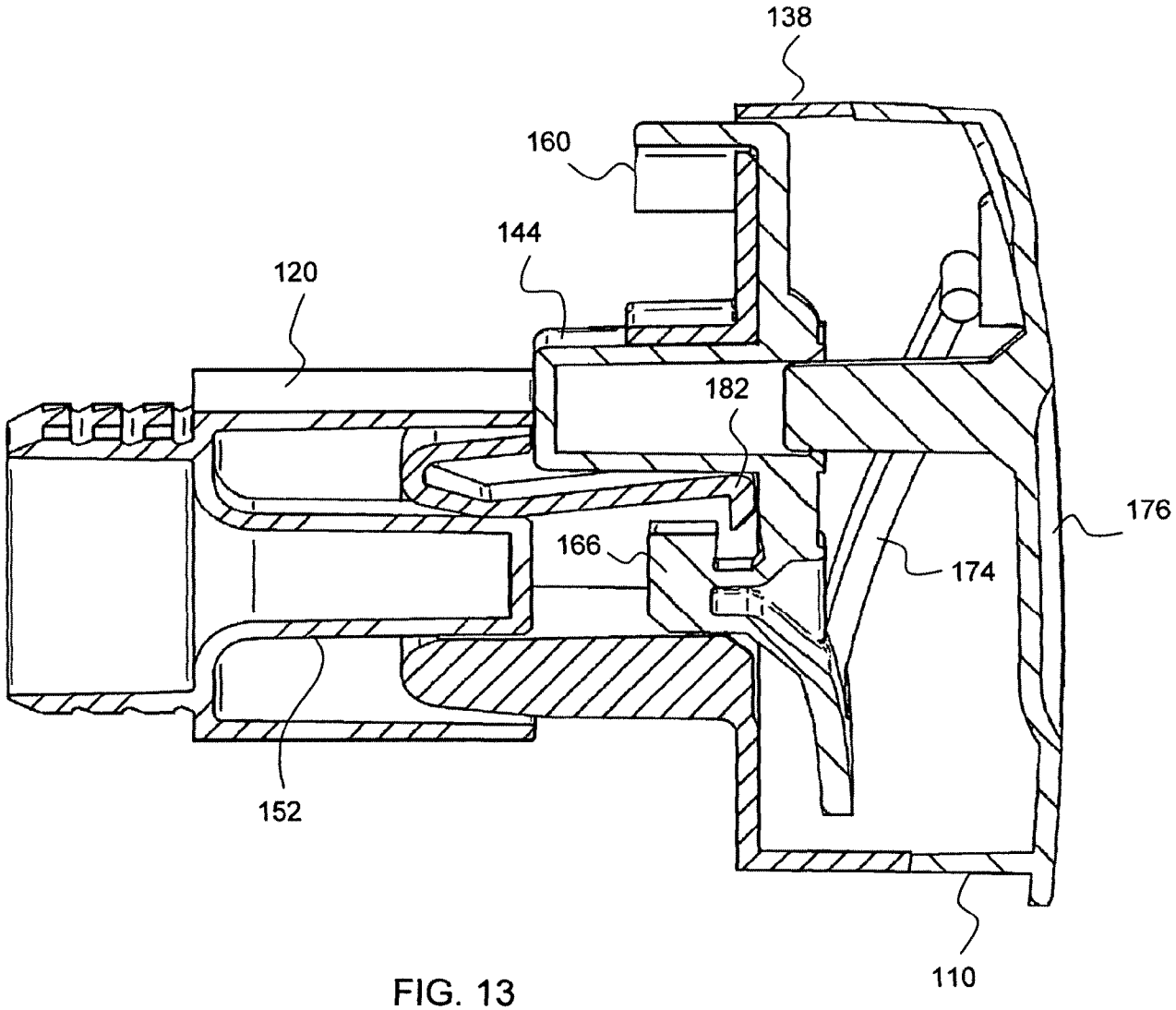
FIG. 13 is a vertical cross-sectional view of the system of FIG. 11 in the first stage of installation.

As may be seen in FIG. 13, at the first stage of insertion, the inner projection has caused the lever arm 180 to deflect radially outwardly and the lug 182 to free the hook 166. With the hook disengaged, the drive block may then be retracted by the outer projection upon further insertion, against the bias of the legs 174, as can be seen in FIG. 14.

In a further variant (not shown), the wall of the aperture may be formed from more than one lever arm and associated lug, and all these lugs may be deflected.

The anti-misuse system is simple and inexpensive to produce, and is simple and effective to use. It can be produced for limited use items, or for items intended to be used for long periods of time. It operates automatically on replacement of a roll, without any act on the part of the user other than straightforward insertion.

In other embodiments, the anti-misuse system may affect the functionality of a dispenser in other ways, e.g. if the lid is a separate hinged component the anti-misuse system may only deploy a hinge pin if the correct roll is fitted or the system may move a portion of the tensioning mechanism so the sheet material can no longer be tensioned if an incorrect roll is fitted. In addition, many of the benefits of the system may be achieved even with a single projection on the bung and no latch mechanism.

In other embodiments, alternatively shaped projections, other resilient biasing mechanisms and other arrangements of drivable abutments may be used. The mechanism may be used with more solidly constructed catering-style dispensing systems.

It will be appreciated that terms such as front and rear, upper and lower are used for ease of explanation, and should not be regarded as limiting. Further, the term projection encompasses any end portion of a roll having one region that projects further than another. Specifically the projection need not project beyond the end of the roll.

The invention claimed is:

1. An anti-misuse system for a sheet dispenser having a roll of sheet material and a housing to receive the roll, wherein the housing comprises a hinged lid, the anti-misuse system comprising:

an end portion of a roll incorporating a first projection;

a corresponding end wall portion of the housing comprising a retracting portion incorporating an interacting mechanism, wherein the interacting mechanism comprises a lug, the retracting portion being movable between a deployed position in which the lug of the interacting mechanism is arranged to block closure of the hinged lid and a retracted position in which the lug of the interacting mechanism is arranged to enable the hinged lid of the sheet dispenser to be closed, wherein the retracting portion further incorporates an abutment drivable by the projection upon insertion of the roll into the housing to move the retracting portion into the retracted position.

2. An anti-misuse system according to claim 1 wherein the hinged lid incorporates a portion of a severing mechanism for severing the sheet material.

3. An anti-misuse system according to claim 1 wherein the lug is arranged to extend inwardly from the end wall portion when in the deployed position.

4. An anti-misuse system according to claim 1 wherein the housing incorporates an axle arranged to support rotation of the end portion thereon.

5. An anti-misuse system according to claim 4 wherein the latch mechanism comprises a ramp surface arranged such that insertion of the second projection causes a portion of the latch mechanism to release.

6. An anti-misuse system according to claim 5 wherein the first portion is integral with the retracting portion.

7. An anti-misuse system according to claim 6 wherein the second portion is located on an axle of the housing.

8. An anti-misuse system according to claim 6 wherein the second portion is located on the end wall.

9. An anti-misuse system according to claim 8 wherein the retracting portion comprises resilient legs.

10. An anti-misuse system according to claim 4 wherein the second projection is arranged concentrically within the first projection.

11. An anti-misuse system according to claim 1 wherein the end portion further comprises a second projection radially separated from the first projection, and the end wall portion comprises a latch mechanism arranged to restrain the retracting portion from retracting, the second projection being arranged to release the latch mechanism upon insertion of the roll prior to the abutment being driven.

12. An anti-misuse system according to claim 11 wherein a first portion of the latch mechanism is associated with the retracting portion.

13. An anti-misuse system according to claim 11 wherein a second portion of the latch mechanism is associated with the housing.

14. An anti-misuse system according to claim 1 wherein the retracting portion is resiliently biased into the deployed position.

15. An anti-misuse system according to claim 1 wherein the end portion of the roll is a bung.

16. An anti-misuse system according to claim 15 wherein the sheet material extends over the bung.

17. A roll of sheet material for a sheet dispenser, the roll incorporating an end portion shaped for the operation of a complementary retracting portion incorporating an interacting mechanism, wherein the interacting mechanism comprises a lug, the retracting portion being movable between a deployed position in which the lug of the interacting mechanism is arranged to block closure of a hinged lid of the sheet dispenser, and a retracted position in which the lug of the interacting mechanism is arranged to enable the hinged lid of the sheet dispenser to be closed;

and wherein the end portion comprises a first projection and a second projection radially separated from the first projection, the first projection being dimensioned so as to release the interacting mechanism upon insertion, and the second projection being arranged to retract the retracting portion upon insertion, thereby enabling closure of the hinged lid.

18. A roll of sheet material according to claim 17 wherein the first projection and second projection are concentrically arranged.

19. A housing to receive a roll of sheet material for dispensing, the housing comprising a hinged lid, wherein the housing further comprises:

an end wall portion, the end wall portion including a retracting portion incorporating an interacting mechanism wherein the interacting mechanism comprises a lug, the retracting portion being movable between a deployed position in which the lug of the interacting mechanism is arranged to block closure of the hinged lid and a retracted position in which the lug of the interacting mechanism is arranged to enable the hinged lid of the sheet dispenser to be closed, wherein the retracting portion further incorporates an abutment drivable by the projection upon insertion of a roll of sheet material into the housing to move the retracting portion into the retracted position.

* * * * *